US007134176B2

(12) United States Patent
Price

(10) Patent No.: US 7,134,176 B2
(45) Date of Patent: Nov. 14, 2006

(54) SUPERPLASTIC FORMING AND DIFFUSION BONDING PROCESS

(75) Inventor: Howard James Price, Preston (GB)

(73) Assignee: BAE Systems plc, Farnborough (GB)

( * ) Notice: Subject to any disclaimer, the term of this patent is extended or adjusted under 35 U.S.C. 154(b) by 232 days.

(21) Appl. No.: 10/499,024

(22) PCT Filed: Dec. 20, 2002

(86) PCT No.: PCT/GB02/05877

§ 371 (c)(1),
(2), (4) Date: Jun. 18, 2004

(87) PCT Pub. No.: WO03/055618

PCT Pub. Date: Jul. 10, 2003

(65) Prior Publication Data

US 2005/0103421 A1 May 19, 2005

(30) Foreign Application Priority Data

Dec. 21, 2001 (GB) ..... 0130710.7

(51) Int. Cl.
*B21D 39/00* (2006.01)

(52) U.S. Cl. ..... 29/421.1; 228/157

(58) Field of Classification Search ..... 29/421, 29/421.2, 428, 890.042, 6.1, 421.1; 156/60; 265/85; 228/157, 193, 161, 173.2, 190
See application file for complete search history.

(56) References Cited

U.S. PATENT DOCUMENTS

| | | | |
|---|---|---|---|
| 4,304,821 | A | 12/1981 | Hayase et al. |
| 4,351,470 | A | 9/1982 | Swadling et al. |
| 4,483,478 | A | 11/1984 | Schulz |
| 4,500,033 | A | 2/1985 | Schulz et al. |
| 4,509,671 | A | 4/1985 | Weisert |
| 4,811,890 | A | 3/1989 | Dowling et al. |
| 5,994,666 | A | 11/1999 | Buldhaupt et al. |

FOREIGN PATENT DOCUMENTS

| | | |
|---|---|---|
| EP | 0 502 620 A1 | 2/1992 |
| WO | WO 02/22286 A1 | 3/2002 |

*Primary Examiner*—John C. Hong
(74) *Attorney, Agent, or Firm*—Crowell & Moring LLP

(57) ABSTRACT

A process of forming a structure by diffusion bonding and superplastic forming includes forming a pack from at least one skin sheet and at least one core sheet, placing the pack in a mould and heating it. A gas is injected between the skin sheet and the core sheet to urge the skin sheet against an internal face of the mould, thereby forming a cavity. Gas is also injected on the other side of the core sheet to urge it against the skin sheet, and gas pressure is maintained on said side of the core sheet thereby forming a diffusion bond between the skin sheet and the core sheet. Helium gas is used to maintain a regulated pressure of helium in the cavity between the skin sheet and the core sheet, which allows such gas trapped between the skin sheet and the core sheet to diffuse through the core sheet.

12 Claims, 3 Drawing Sheets

SUPERPLASTIC FORMING AND DIFFUSION BONDING PROCESS

TECHNICAL FIELD

The present invention relates to the forming of a structure using diffusion bonding (DB) and superplastic forming (SPF) techniques. The invention has particular application in the aerospace industry in the production of panels and structures for aircraft.

BACKGROUND ART

Combined superplastic forming /diffusion bonding (SPF/DB) is an established technique for making structural components, particularly lightweight components requiring complex internal structures, from materials that exhibit superplastic properties at elevated temperatures. These materials are primarily titanium alloys, especially (but not exclusively) titanium/aluminium/vanadium alloys.

Typical examples of known superplastic forming/diffusion bonding processes are described in U.S. Pat. No. 5,143,276, U.S. Pat. No. 4,534,503, GB-2,030,480, GB-2,129,340, U.S. Pat. No. 4,607,783U.S. Pat. No. 4,351,470, U.S. Pat. No. 4,304,821, U.S. Pat. No. 5,994,666 and EP-0,502,620.

A typical known SPF/DB process will now be described in connection with FIG. 1, which shows four steps for forming a panel. In step 1, stopping off material may be applied between two core sheets 10, 12; stopping off material forms a layer that prevents the core sheets being diffusion bonded together at operating temperatures in the areas to which the stopping off material has been applied. The core sheets are then joined together by line bonds 14. These bonds can be formed by diffusion bonding the two core sheets 10,12 together, in which case the stopping off material should be omitted in the region of the line bonds 14. Alternatively, the core sheets can be bonded together by other techniques, for example resistance welding or laser bonding.

In step 2, a pack assembly is formed by sandwiching the core sheets 10, 12 between skin sheets 16, 18; the pack may then be sealed around its outer perimeter by a weld or a bond (not shown). Ducts are included in the pack assembly allowing gas to be injected into the region between the core sheets 10, 12 and independently in the region between the skin sheets 16, 18 and their adjacent core sheets, 10, 12. If necessary, gaps can be left in the line bonds 14 to allow the passage of gas between adjacent regions of the core sheets.

In step 3, the pack assembly is then placed between two halves of a moulding tool 20 that can be heated. The two halves of the moulding tool 20 are pressed together to form a gas tight seal between the edges of the pack assembly and the internal cavity in the tool. The clamping forces, when subsequently supplemented by heating, can provide for the development of diffusion bonds 21 around the periphery of the pack if so desired.

The tool is heated to a temperature at which superplastic forming takes place, which is typically in excess of 850° C. for a typical alloy, such a Ti-6% Al-4% V. An inert gas is firstly injected between each skin sheet 16, 18 and its adjacent core sheet 10, 12 respectively. This causes the skin sheets 16, 18 to be urged against the internal face of the mould tool 20, thereby adopting the shape of the internal face of the mould tool 20. Once the skin sheets 16, 18 have been urged away from the core sheets 10, 12, e.g. once they have been partially or fully formed into shape by the tool 20, gases are injected between the core sheets 10, 12 causing the areas between the bonds to "inflate". The inflation continues until the core sheets form a series of cells 22 divided by walls 24. The upper half of each wall 24 is formed by a double-backed section of core sheet 10; likewise, the bottom half of each wall 24 is formed by a double-backed section of core sheet 12. The bonds between the two halves of the wall are the line bonds 14 formed in step 1.

In step 4, the gas pressure within the cells 22 is maintained for a time after the cells have been inflated to form diffusion bonds 28 between the skin sheets 16, 18 and the adjacent areas of the core sheets 10, 12. Likewise, diffusion bonds 28 are formed between the double-backed sections of the core sheets 10,12 forming the walls 24 and between the outer edges 26 of the outer perimeter of the pack compressed by the two halves of the moulding tool 20.

The strength of the panel is greatly enhanced by the presence of the diffusion bonds 28 and it is desirable that they should be formed at all interfaces between the core sheets and the skin sheets. To that end, the gas within the cavities 30 between the core sheets and the skin sheets is controlled and gas is withdrawn from the cavities as they shrink during inflation of the cells to prevent the gas being trapped between the core and skin sheets, which would prevent intimate contact between these sheets and so hinder diffusion bonding. Gas is withdrawn from the cavities 30 in the region of the spandrels 32 formed at the top and bottom of the walls 24 between the core sheets and the skin sheets.

At superplastic forming temperatures, titanium alloys can form a surface layer (or "case"), which is an alpha phase formed particularly in the presence of alpha phase stabilising elements, such as oxygen and nitrogen. The formation of an alpha case in a location that is to be diffusion bonded drastically reduces the strength of the diffusion bond and in addition has a detrimental effect on fatigue performance. For this reason, the gas used in superplastic forming should be substantially free of such alpha case stabilising elements and so a high purity gas with a very low content of alpha case stabilising elements (in excess of 99.999% purity) should be used. In addition, the gas is customarily passed over a "getter" to further reduce the amount of any impurities that may be present. The gas that is almost universally used in superplastic forming is argon because it is inert and relatively cheap. Other inert gases have not been used since there has been no perceived advantage in using them over and above argon.

During the inflation of the core sheets, when the core sheets first contact the skin sheets (so-called "sticking contact"), there is a tendency for a compressive stress to be imparted by the expanding core sheets to the skin ahead of the advancing sticking contact point. This progressive stress can cause buckling of the skin layer, which is unsupported ahead of the advancing sticking contact point. The development of such buckling eventually causes excess skin material to be drawn into the cell structure at the point of the cell boundaries (i.e. above the spandrels) and a line defect in the skin occurs above the spandrels. It is customary, in order to minimise skin buckling, to maintain a back pressure of gas in the cavity 30 between the core sheet and the skin sheet during inflation of the cores. The magnitude of the back pressure necessary to avoid such buckling depends on the relative thickness of the core and the skin sheets and the geometry of the cells. The back pressure is normally removed once the cores have been fully formed (or approaching being fully formed) in order to prevent gas being trapped between the core sheet and the skin sheet, which reduces the strength of the diffusion bond between these sheets or indeed can prevent a diffusion bond being formed in those areas where gas is entrapped. Gas is usually removed from the cavity between the core and skin sheets via the spandrels, which maintains a gas conduit for at least a time after the core cells have been substantially formed. Thus, the removal of the back pressure between the core and skin sheets minimises the degree of potential gas entrapment within the spandrel structure that may result if the spandrel network should subsequently become blocked.

A schematic pressure-time cycle (PTC) in respect of the inflation of the core sheets is shown in FIG. 2. FIG. 2 does not include a PTC in respect of the inflation of the skin sheets. As can be seen, a back pressure (dashed line (-----) "a") is maintained between the core sheets and the skin sheets during inflation of the core sheets (step 3, indicated by arrow "3") but, once the core cells 22 have been substantially formed, the back pressure is removed and the pressure within the core cells is maintained for a predetermined time to allow for diffusion bonding within the panel. The pressure in the cells 22 is indicated by chained line (____) "b", giving a net pressure across the core sheets 10,12 indicated by solid line(_____) "c".

The quality of the diffusion bonds formed during and after superplastic forming can be adversely affected by the use of a back pressure of gas in the cavity between the core sheets 10,12 and the skin sheets 16,18 caused, it is believed, by entrapment of small pockets of gas during the SPF/DB process. This is true even in the case of a PTC shown in FIG. 2 where the backing gas is evacuated as the cores are formed and the cavity between the core sheet and the skin sheet reduces in size. FIG. 3 shows a photomicrograph through the diffusion bonded region between a core sheet and a skin sheet using the above-described SPF/DB process. The black areas show entrapped gas. The rounded nature of the ends of the malformed bonds ("disbonds") is characteristic of there having been gas entrapment preventing intimate contact from occurring. The absence of any alpha case at the bond line confirms that the surfaces of both layers were clean during diffusion bonding.

Without wishing to be committed to any particular theory, it is believed that the gas is trapped as a result of high levels of strain-induced surface roughness. During superplastic forming, the high level of strain is accommodated by the material of the sheets by a process known as "grain boundary sliding", that is to say individual grains within the metal slide past each other during superplastic forming. The inevitable result of grain boundary sliding is that the surfaces of the sheets become roughened at a microstructural level due to individual surface grains protruding out of the original planar surfaces of the sheets being formed. As the surfaces of the core and skin sheets are brought into intimate contact under the application of the bonding pressure within the cores, any previously roughened surfaces will deform to produce an essentially flat interface. However, it is believed that gas can become trapped in the crevices behind protruding grains and become isolated from the receding cavity that will eventually become the spandrel. Without such a vent path back to the spandrel, a pocket of gas forms and prevents diffusion bonding. The application of back pressure compounds the above problem since a greater quantity of gas will be present in the cavity between the sheets to be diffusion bonded.

WO02/22286 describes a method of superplastic forming a single sheet using a silica mould. In order to prevent excessive contact between the sheet and mould, which could contaminate the sheet, a barrier is formed between the sheet and the mould, which may be solid or gaseous, e.g. boron nitride or an inert gas such as helium or argon.

U.S. Pat. No. 4,500,033 discloses a method of expelling entrapped air during superplastic forming by coating the superplastic sheets with a material that decomposes at a temperature below superplastic forming temperature to form an inert gas. The decomposition gas is then flushed out together with entrapped air by means of argon.

DISCLOSURE OF INVENTION

The present invention is based on the concept of allowing the gas used for forming the back pressure in the cavity between the core and skin sheets to diffuse through the core and/or skin sheet(s) if an entrapment pocket is ever formed. This is achieved by using a gas with a smaller atomic diameter than the universally used argon gas. The preferred gas is helium.

According to the present invention, there is provided a process of forming a structure by diffusion bonding and superplastic forming at least one skin sheet and at least one core sheet, the process comprising:

a) forming a pack from the at least one skin sheet and the at least one core sheet;

b) placing the pack in a mould and heating the pack to a temperature at which the sheets are capable of superplastic deformation;

c) injecting a gas between the skin sheet and the core sheet to urge the skin sheet against an internal face of the mould thereby forming a cavity between the skin sheet and the core sheet;

d) injecting gas on the side of the core sheet remote from the skin sheet to urge the core sheet against the skin sheet, e) maintaining gas pressure on the said side of the core sheet remote from the skin sheet, thereby forming a diffusion bond between the skin sheet and the core sheet; and f) maintaining a regulated pressure of a gas in the cavity between the skin sheet and the core sheet during at least part of step d);

wherein the gas used in step f) to maintain the pressure of gas in the cavity between the skin sheet and the core sheet is helium, which can diffuse through the core sheet.

An alloy often used in SPF is fine-grained equi-axial alpha-beta-phase Ti-4% Al-4% V alloy, the alpha phase of which has a body centred cubic structure and the beta phase of which has a close packed hexagonal structure. It can be calculated that an atom having 41% of the radius of titanium atoms will readily diffuse through the hexagonal close packed structure. Obviously, due to vibration of the metal atoms and the presence of vacancies within the lattice, larger atoms will also diffuse through. Helium has an effective atomic radius that is 55% that of titanium and will enable a relatively high rate of diffusion of helium through titanium. The corresponding values for neon and argon are 110% and 132% respectively. Argon will not diffuse through titanium at an appreciable rate.

However, in the same way as helium could diffuse into or through the titanium core sheet in the event of an entrapment pocket being formed between the core and skin sheets, helium could diffuse into the pocket if it were used for inflating the cores. Indeed, since the pressure within the core cells being formed is greater than the back pressure in entrapment pockets, it is expected that, if helium were used for inflating the cores, the rate of diffusion of helium into the cavity between the core and skin sheets would be greater than the rate of diffusion in the other direction.

The above problem can be solved by using a different gas within the cavity between the core and skin sheets as compared to the gas used to inflate the cores. The heavier the gas, the lower its diffusion rate through the core sheet will be. Thus, by using a lower atomic weight gas within the cavity than is used to inflate the core sheets, the diffusion out of the entrapment pocket will be greater than any diffusion of gas into the entrapment pocket. In other words, if helium is used to form the back pressure within the core/skin cavity, neon or argon could be used to inflate the core cells.

Another potential problem is one of ensuring that the helium gas can cross the gas-metal interface. The non-inert gases (e.g. hydrogen, nitrogen and oxygen) enter metals by dissociation from the molecular to the atomic form and chemisorption at the interface. The gas then dissolves locally and diffuses down the concentration gradient, i.e. from the high to low concentration. For inert gases, the chemisorption process does not occur. Hence, for helium to diffuse through titanium, a way must first be found to satisfy the activation energy required to enable the gas to transfer across into the metal. The easiest way of promoting transfer across the gas-metal interface in the particular case of gas entrapped during the SPF/DB process is to provide a suitable pressure differential across the core sheet by reducing the pressure within the core 22 and maintaining the pressure within the core cells at such lower level to effect a flow of high pressure helium gas from within the entrapment pocket into either the core or skin sheets or the core cells. Diffusion of gas will then occur in the direction down the concentration gradient—i.e. away from the pocket. The pressure of the gas in the entrapment pocket will then fall. The rate of the pressure reduction in the entrapment pocket will decrease as the pressure differential reduces and eventually the flow will cease. The pressure in the core should therefore be increased, generally once the rate of flow of gas from within the entrapment cavity has reduced to an unacceptably low rate. This increase in pressure will then cause the core sheet to move towards the skin sheet thereby reducing the size of the pocket and so increasing the pressure of the gas remaining within the pocket. The process will continue until the pressure of the entrapped gas within the pocket once again approaches the pressure of the gas within the core. To facilitate further reductions in the size of the gas entrapment pockets, additional low/high pressure cycles can be applied.

BEST MODE FOR CARRYING OUT THE INVENTION

Figure 1:
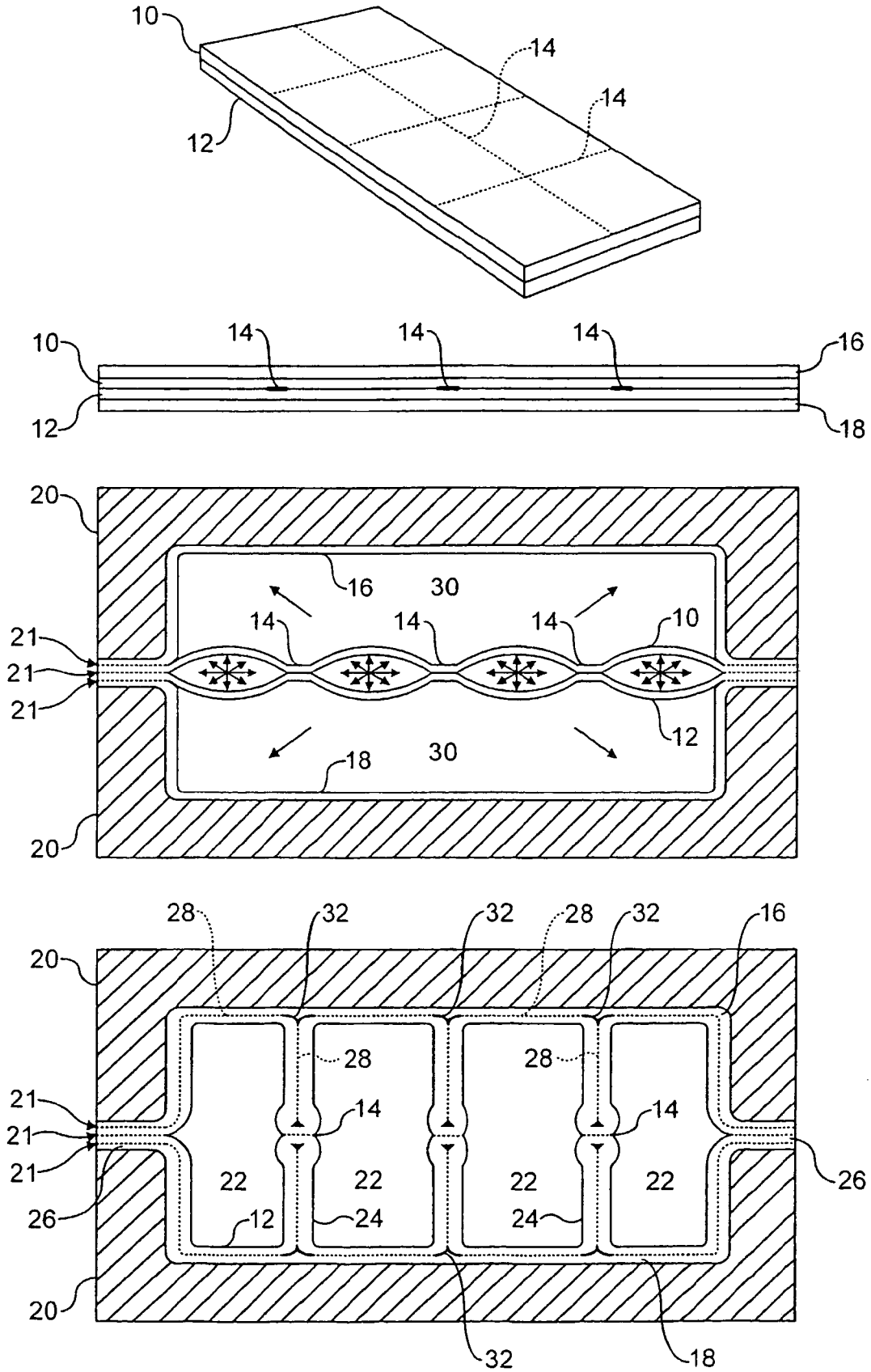
FIG. 1 is a schematic illustration of a known diffusion bonding process.
Figure 2:
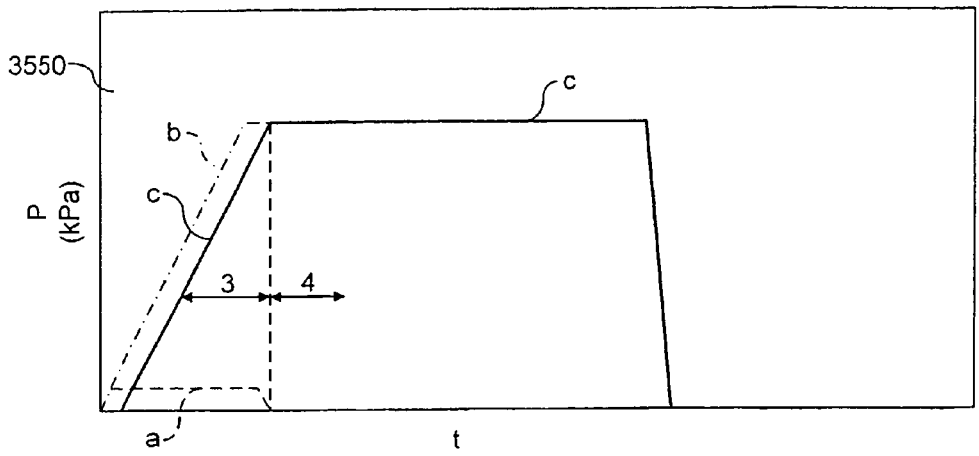
FIG. 2 Prior Art
FIG. 2 is a schematic pressure-time cycle (PTC) showing the pressure prevailing in different stages of a known SPF/DB process, such as that described in connection with FIG. 1.

The invention is preferably carried out as described in connection with FIG. 1 using argon to inflate the skin sheets 16,18 and to inflate the core sheets 10,12. However, in accordance with the present invention, after the skin sheets 16,18 have been superplastically formed, the argon in the cavities 30 between the skin sheets 16,18 and their respective core sheets 10,12 is replaced by helium. The back pressure of helium in these cavities 30 is maintained in a controlled way, in a manner that is well-known from the prior art. However, in a preferred embodiment, one or more periods are introduced into the diffusion bonding step (step 4) in which the pressure of argon within the core cells 22 is lowered as will now be described.

Figure 4:
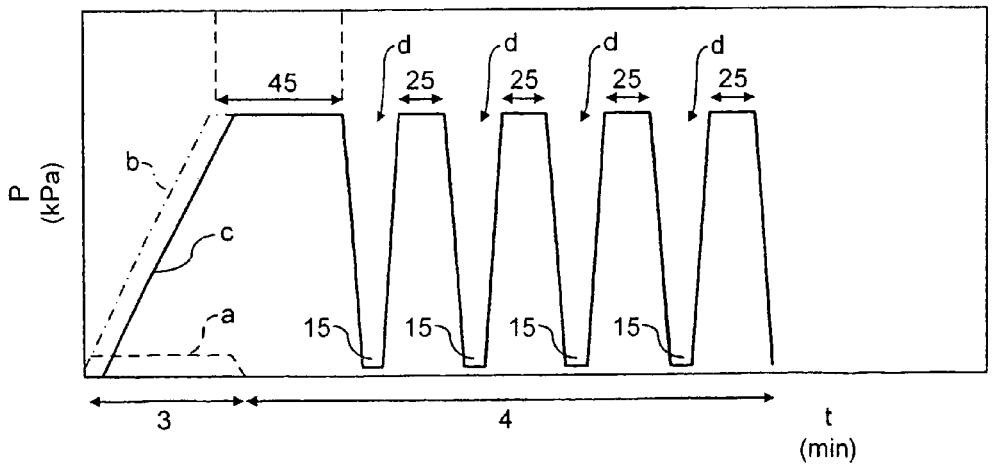
FIG. 4 is an exemplary schematic pressure-time cycle (PTC) showing the absolute pressure prevailing in different stages of a SPF/DB process according to the present invention.
Figure 3:
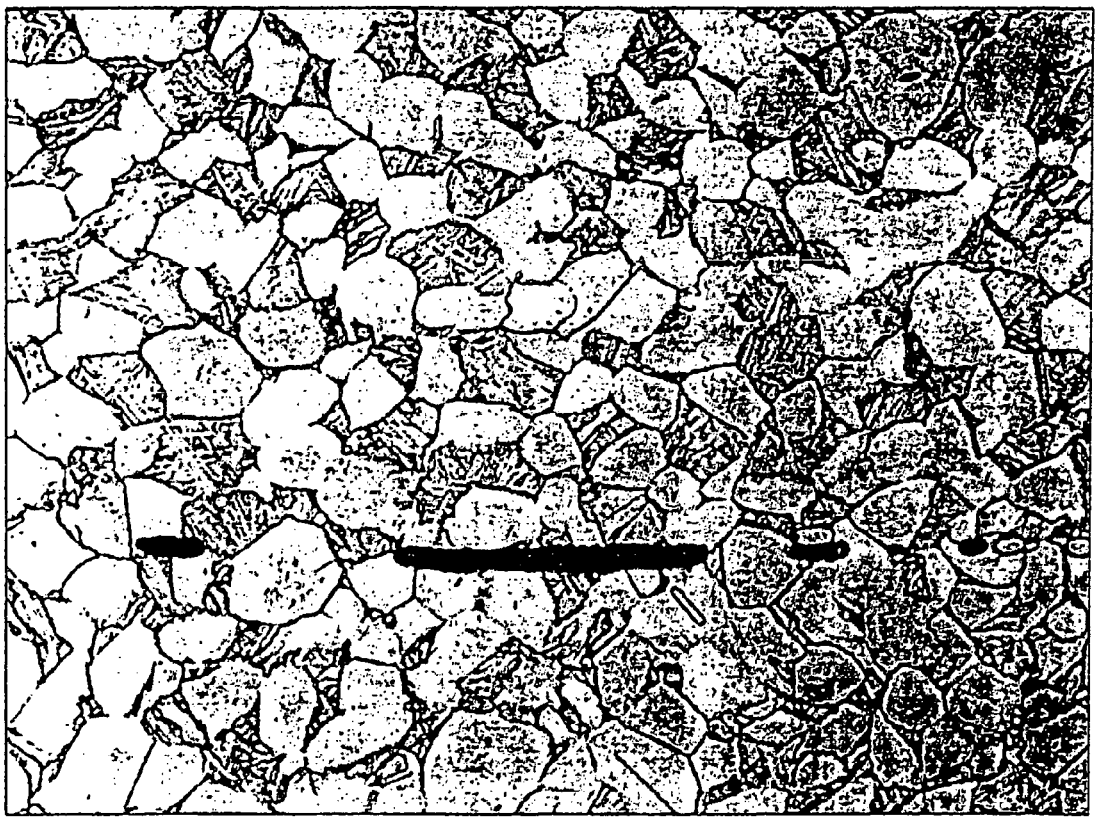
FIG. 3 Prior Art
FIG. 3 is a photomicrograph through the diffusion bond of a known SPF/DB process, such as that described in connection with FIG. 1.

A typical schematic PTC for a regime according to the present invention is shown in FIG. 4, which is a plot of absolute pressure P (kPA) against time t during the core forming part of step 3 and during the diffusion bonding step 4 of the process described in connection with FIG. 1 but modified according to the present invention as specified below. The core forming step, indicated by arrow "3" on the x-axis in FIG. 4, takes place with a back pressure in cavity 30 (shown by dashed line (-----) "a" in FIG. 4) and a pressure in core cells 22 that forms the cores (shown by chained line (_._._.) "b" in FIG. 4), resulting in a net pressure across the core sheets 10,12 shown by a solid line (_____) "c" in FIG. 4). During the diffusion bonding step, indicated by arrow "4" on the x-axis in FIG. 4, the back pressure (dashed line "a") is no longer maintained and so the net pressure (solid line "c") is the pressure prevailing in the cells 22 to bring about diffusion bonding. A high pressure of 3550 kPa is maintained for the first part of the diffusion bonding step 4 in FIG. 4, following which four low/high pressure periods "d" are introduced during the diffusion bonding period, the high pressure being 3550 kPa and the low pressure being approximately 135 kPa. The values given pressure plots in FIG. 4 indicate the duration (in minutes) of the various parts of the pressure cycle.

The identification of the optimum cycle conditions, in terms of the number of low/high pressure cycles within the core cells 30 and the length of each of the various low pressure periods will be dependent on the following, amongst other, factors:

1) Maximum applied bonding pressure. The higher the bonding pressure applied in the core, the less likely it is that any gas entrapment pocket will prevent intimate contact between the sheets being diffusion bonded. However, the pressure required to completely eliminate the need for low-pressure periods would be of the order of the pressures used in hot isostatic pressing (HIP), which is greater than 100 MPa. In practice, the maximum pressure that is likely to be applied during an SPF/DB process is 10 MPa and would more commonly be approximately 5 MPa. Hence, using the arrangement just described, the number and length of any low pressure periods will reduce with increasing pressure applied.

2) Initial bonding time prior to pressure pulse cycling

3) The level of SPF strain, strain rate and the grain size. These factors together will determine the degree of strain-induced roughness and so influence the propensity for forming gas entrapment pockets.

3) The thickness of the core/skin sheets. The rate of permeation of helium gas through a core/skin sheet will be inversely proportional to the thickness of the sheet. Thus, an increased dwell time is required if a relatively thick core sheet is used.

4) The level of back pressure. A back pressure of, say, 0.3 MPa is typically used. Significantly higher or lower back pressures will influence the level of gas entrapment and so influence the optimum conditions for its elimination.

5) The temperature of the DB process. A typical temperature for SPF/DB is 1170 to 1200° K. In accordance with Fick's law of diffusion, the higher the temperature, the higher the rate of diffusion.
6) The rate of diffusion/permeation. The higher the rate of permeation/diffusion of the helium gas through the core sheets and/or the skin sheets, the fewer number of cycles are required in order to eliminate gas within an entrapment pocket to such an extent that, on re-establishment of the high pressure within a cell following a low-pressure period intimate contact between the core and skin sheets will occur, thereby allowing diffusion bonding to take place.
7) Other factors that affect the process include:
Minimum pressure during pressure pulse cycling
Dwell time at maximum pressure during cycling
Dwell time at minimum pressure during cycling
Pressurisation and de-pressurisation rate.
Number of repeat pressure pulse cycles.

Trials carried out to study the effect of the above parameters on the quality of sheet to sheet bonds in cellular structures, formed from 2 mm thick sheet in Ti-6Al-4V with grain size of approximately 4–6 μm, revealed the following criteria with respect to forming a good quality ski-to-skin bond:

A forming temperature of 927° C. at an inflation pressure of 500 psi (3450 kPa) is sufficient to allow superplastic forming of the sheet material. A typical strain rate for superplastic forming of fine-grained Ti-6Al-4V is $2\times10^{-4}$).

An initial dwell time of 45 minutes at maximum pressure within the core cells 22 after removal of the back pressure and prior to pressure pulse cycling was sufficient to cause a preliminary bond between the core and skin sheets.

A superplastic forming pressure of 3550 kPa produces better quality sheet to sheet bonds than does 2170 kPa.

4 pulse cycles reduces the size of disbond cavities between the core sheets 10,12 and the face sheets 16,18 more effectively than 2 pulse cycles.

A dwell time of 25 minutes at maximum pressure, between cycles, aids the collapse of any remnant disbond cavities but a dwell time of 15 minutes at maximum pressure, between cycles, was found to be insufficient to cause disbond cavity collapse.

A dwell time of 15 minutes at minimum pressure is sufficient to allow entrapped helium in the disbond cavities to diffuse into the Ti alloy matrix. Longer dwell times at minimum pressure may provide enhanced diffusion of the helium into the titanium.

Preferably, the conditions used are such that the number of low pressure dwell periods is minimised consistent with achieving good bonding between the face and core sheets.

It is well known that helium can, in certain circumstances, lead to embrittlement of metals; this is well established in the nuclear power industry. If helium were used for superplastic forming of the skins and cores, a substantial flow of helium through the core and skin layers could be expected particularly in the regions requiring maximum pressure to form the layers against the tool surface. For this reason in addition to the reason of preventing diffusion of helium from the core into the pockets, it is preferred to restrict the use of helium to provide the back pressure between the core and skin sheets; the gas used for superplastic forming of the skin layers to conform to the internal shape of the mould and to inflate the core sheets to form the cells would take place with a traditional gas, particularly argon. Since the pressure of helium within the core-to-skin cavities 30 will be relatively low as compared to the argon pressure prevailing in the core cells 22 (see FIG. 4), the amount of helium entering the core sheet and diffusing through the core sheet during core formation is expected to be low. Similarly, very little helium would be expected to diffuse into the skin sheets during core forming. It is estimated that residual helium concentration adjacent to a prior entrapment pocket that has been collapsed as a result of helium permeation would be of the order of 1–2 parts per million, which is well below a level likely to be of concern for causing embrittlement.

It will be appreciated that one or both of the above two processes for bringing about a net flow of gas from entrapment pockets, i.e. using low pressure periods during diffusion bonding and the limiting of the use of helium to forming the back pressure in the core/skin cavities 30, could be used.

The actual nature of the product made by superplastic forming is not relevant to the present invention so long as at least one skin sheet is used and at least one core sheet is used. In this context, a skin sheet is a sheet that is superplastically formed to the internal shape of a mould. A core sheet is a sheet that is superplastically formed after the skin sheet and so, while it is being superplastically formed, a cavity exists between the core sheet and its associated skin sheet. Subsequently, the core sheet and the skin sheet are diffusion bonded together. It is possible to have only one skin sheet in the structure; e.g. two core sheets could be provided, one of which is pressed against the skin sheet and diffusion bonded thereto and the other is pressed against the internal surface of the mould, thereby providing an outside surface in which the spandrels are visible.

A single core sheet can be provided with two skin sheets such that the core sheets zigzags between the two skin sheets; such an arrangement is well known.

The preferred structure of the present invention has two core sheets and two skin sheets. However, a greater number of core sheets can be provided, if required.

The techniques used for superplastic forming/diffusion bonding and in particular the gas management within the SPF/DB mould are all well known and are directly applicable to the present invention, with the modifications described above.

The invention claimed is:

1. A process of forming a structure by diffusion bonding and superplastic forming at least one skin sheet and at least one core sheet, the process comprising:

a) forming a pack from the at least one skin sheet and the at least one core sheet;
b) placing the pack in a mould and heating the pack to a temperature at which the sheets are capable of superplastic deformation;
c) injecting a gas between the skin sheet and the core sheet to urge the skin sheet against an internal face of the mould thereby forming a cavity between the skin sheet and the core sheet;
d) injecting gas on the side of the core sheet remote from the skin sheet to urge the core sheet against the skin sheet,
e) maintaining gas pressure on the said side of the core sheet remote from the skin sheet, thereby forming a diffusion bond between the skin sheet and the core sheet; and
f) maintaining a regulated pressure of a gas in the cavity between the skin sheet and the core sheet during at least part of step d);

wherein the gas used in step f) to maintain the pressure of gas in the cavity between the skin sheet and the core sheet is a different gas than the gas used in steps d) and e).

2. A process as claimed in claim 1, wherein the gas used in step c) is argon or neon.

3. A process as claimed in claim 1, wherein the gas used in steps d) and e) is argon or neon.

4. A process as claimed in claim 1, wherein, during step e), the pressure on the side of the core sheet remote from the skin sheet is reduced during at least one period to allow gas in any remnant part of the said cavity to diffuse through the core sheet.

5. A process as claimed in claim 1, wherein, during step e), the pressure on the side of the core sheet remote from the skin sheet is reduced during at least one period to allow gas in any remnant part of the said cavity to diffuse into the core sheet.

6. A process as claimed in claim 1, wherein at least two core sheets are used that have been joined together in selected areas and the gas injected in step d) is injected between the at least two core sheets.

7. A process as claimed in claim 6, wherein two skin sheets and at least two core sheets are used to form the structure, wherein the core sheets have been joined together in selected areas, the pack in step a) is formed by sandwiching the core sheets between the skin sheets, the gas is injected in step c) between each skin sheet and its adjacent core sheet, the gas injected in step d) is injected between the core sheets, and, in step f), the pressure is maintained in the cavity between each skin sheet and its adjacent core sheet.

8. A process as claimed in claim 1, wherein two skin sheets are used and the gas is injected in step d) between each skin sheet and its adjacent core sheet.

9. A process as claimed in claim 1, wherein the gas used in steps c), d) and e) is argon or neon.

10. The process according to claim 1, wherein the gas that is used in step f) has a lower atomic weight than the gas that is used in steps d) and e).

11. The process according to claim 10, wherein the gas that is used in step f) is helium.

12. The process according to claim 11, further comprising maintaining a pressure differential across the core sheet by reducing pressure which urges the core sheet against the skin sheet relative to pressure on an opposite side of the core sheet, such that helium gas migrates through said core sheet.

* * * * *